United States Patent [19]

Martin et al.

[11] Patent Number: 4,851,111

[45] Date of Patent: Jul. 25, 1989

[54] APPARATUS FOR SCREENING PAPER FIBER STOCK

[75] Inventors: Andrew C. Martin, Nuns Island, Canada; Christian Sauzedde, Yvrac, France

[73] Assignee: The Black Clawson Company, Middletown, Ohio

[21] Appl. No.: 119,744

[22] Filed: Nov. 12, 1987

Related U.S. Application Data

[63] Continuation-in-part of Ser. No. 764,263, Aug. 9, 1985, abandoned.

[51] Int. Cl.[4] ..... B07D 1/24

[52] U.S. Cl. ..... 209/304; 209/488

[58] Field of Search ..... 209/270, 273, 240, 488, 209/300, 306, 303, 304; 210/297, 298

[56] References Cited

U.S. PATENT DOCUMENTS

| | | | |
|---|---|---|---|
| 3,243,041 | 3/1966 | Cowan | 209/273 |
| 3,508,651 | 4/1970 | Hooper | 210/772 |
| 4,165,283 | 8/1979 | Weber et al. | 210/111 |

*Primary Examiner*—Andres Kashnikow

*Assistant Examiner*—Kevin P. Weldon

*Attorney, Agent, or Firm*—Biebel, French & Nauman

[57] ABSTRACT

In screening apparatus for paper fiber stock of the type wherein a cylindrical perforate screen member defines screening and accepts chambers on the inner and outer sides thereof in a closed, pressurized housing, the inlet chamber for stock to be screened is located below the screening chamber to facilitate elimination of high specific gravity reject materials before the stock reaches the screening chamber. Special provision is made for accelerating the flow of plastic and other reject materials of lower specific gravity than wet paper fibers to a reject chamber above the screening chamber, and special provision is also made for preventing recirculation of such reject materials to the lower end of the screening chamber and thereby concentrating them in the reject chamber from which they are removed by way of a dewatering device that delivers essentially dry reject material for ready disposal while preventing the escape of pressure from the housing. The effectiveness and efficiency of the apparatus is further promoted by special provision for washing fiber away from reject materials in the upper portion of the screening chamber and thereby increasing the overall yield of recovered fiber.

7 Claims, 5 Drawing Sheets

APPARATUS FOR SCREENING PAPER FIBER STOCK

CROSS-REFERENCE TO RELATED APPLICATION

This application is a continuation-in-part of our application Ser. No. 764,263, filed Aug. 9, 1985 and now abandoned.

BACKGROUND OF THE INVENTION

Paper mills have for many years made extensive use, for the screening of paper making stock, of screening apparatus embodying a cylindrical perforate screen member defining screening and accepts chambers on the opposite sides thereof in a closed housing and provided with a rotor member which operates in one of the chambers to keep the screen perforations open and free from solid materials tending to cling to the screen surface. In operation, the stock or furnish is delivered to the screening chamber adjacent one end of the screen member, and the material rejected by the screen member is collected and discharged from the opposite end of the screen member.

The assignee of this invention has manufactured and sold many such screens, originally in accordance with Staege U.S. Pat. No. 2,347,716, and subsequently in accordance with Martindale U S. Pat. No. 2,835,173, the latter construction being characterized by a rotor comprising bars or vanes of air-foil section in closely spaced but non-contacting relation with the surface of the screen member. Similar screens have been marketed for some years, in competition with those of the assignee of this invention, in accordance with other patents, such as Cannon et al U.S. Pat. Nos. 2,975,899, Lamort 3,617,008 and Holz 3,581,983.

The art has also experimented widely with detailed variations in screens of the above type, including variations in the size, spacing and configuration of the perforations in the screen member and also in the vane shape and in other forms of rotor. For example, such screens have been offered in recent years wherein the rotor is a drum-like member provided with multiple bumps or other offset portions over its surface. Typical such constructions are shown in Clarke-Pounder U.S. Pat. Nos. 3,363,759 and Bolton et al 3,726,401.

In all of the vertically oriented commercial screens of the type outlined above, the primary direction of through flow is downwardly, with the stock entering the screen chamber from above, or in some cases centrally of the screening chamber when the direction of screening is from the outside to the inside of the screen member, so that any high specific gravity reject material entrained with the stock to be screened will travel by gravity to a reject discharge chamber in the lower part of the screen, from which it is subsequently discharged. Necessarily, therefore, there is substantial opportunity for such reject material to damage the perforate screen member as it travels through the screening chamber, especially with screens of the type wherein the screening chamber is on the inside of the perforate screen member, and wherein centrifugal force therefore will cause high specific gravity materials to travel along the screening surface.

Another type of reject material, which is becoming increasingly prevalent in waste paper stocks, is material of lower specific gravity than the paper fibers, such as pieces of plastic, especially scraps of plastic foam. The circulatory movement imparted to the stock in the screening chamber by whatever rotor is used will develop centrifugal force which will tend to cause such light materials to migrate toward the center of the screening and reject chambers. However, in order to discharge these concentrated light reject materials, it is necessary for them to overcome the gravitational forces which tend to cause them to rise within the apparatus and therefore away from the reject discharge outlet.

Weber U.S. Pat. No. 4,166,068 discloses a different construction of screening apparatus of the general type outlined above wherein the supply flow of stock to be screened enters the apparatus by way of an inlet chamber located entirely below the screening chamber, and wherein low specific gravity reject materials, including materials of substantially the same specific gravity as accepted fiber, are collected in a reject chamber above the screening chamber, and from which they are discharged by a port located generally centrally of the top wall of the apparatus in order to ensure effective removal of light reject materials of the types discussed above.

In the apparatus of the Weber patent, the high specific gravity reject materials entering through the stock inlet are retained in the inlet chamber by constructing the inlet and screening chambers so as to provide an annular space in the inlet chamber which is of greater outer diameter than the flow passage through which the stock enters the screening chamber, and producing sufficient centrifugal force in the inlet chamber to cause these high specific gravity materials, such as tramp metal and the like, to be collected in this annular space and thereby to prevent them from coming into contact with the screen member Such trapped high specific gravity materials are discharged from time to time directly from this annular space by the reject outlet means, so that only materials of approximately the same specific gravity as paper fiber or a lower specific gravity are allowed to reach the screening chamber.

SUMMARY OF THE INVENTION

The present invention is particularly concerned with the provision of screening apparatus which will be especially adapted for effective and efficient screening of the reject "tailings" from a primary screening station in a system for recovering reusable paper fiber from waste paper products, such for example as a system like that in Chupka U.S. Pat. No. 3,873,410.

The tailing the primary screening station in such a system are commonly relatively rich in light specific gravity reject materials, such particularly as pieces of plastic sheet, film and foam, but substantial quantities of good paper fiber are entrained or otherwise mixed and rejected therewith. It is for this purpose that a tailings screen is provided, and it has been common to use a vibrating screen for this purpose, but a related practical problem is that the relatively significant volume of reject materials normally leaves the tailing screen as a relatively small percentage of a correspondingly large volume of water suspension, and that water must be eliminated before the solid reject materials can be disposed of.

The screen of the present invention was especially developed for handling such tailings with the dual objective of recovering substantially all of the good paper making fiber and delivering the reject materials in relatively concentrated form, and preferably in substantially dewatered form for ready final disposal. In addition, the screen of the invention accomplishes these objectives at notably lower cost than existing screens for similar applications, particularly from the standpoint of both power and water usage.

The screen of the invention is generally similar in construction and mode of operation to the screen disclosed in the above-noted Weber patent, but it differs therefrom in a number of significant respects. More specifically, the screen of the invention differs from the screen shown in the Weber patent in the structure and mode of operation of its means for treating reject materials of lower specific gravity than paper fibers.

The supply flow of stock to be screened enters the apparatus by way of an inlet chamber located below the screening chamber, and any high specific gravity materials which are present in that supply flow are trapped in the inlet chamber, in substantially the same manner as disclosed in the Weber patent. Thus the solid materials in the supply flow of stock into the screening chamber consist essentially of reusable fiber and low specific gravity reject materials. Special provision is made in accordance with the invention for minimizing the possibility of light reject materials passing through the perforations in the screen cylinder, and further for washing good fiber free from the light reject materials and then concentrating those reject materials prior to their discharge from the screen.

It is important to this objective that provision be made for preventing light reject materials which have passed through the screening chamber from recirculating back to its inlet end. This result is accomplished in accordance with the invention by a baffle arrangement which in effect separates the screening chamber into a lower zone from which most of the good fiber is accepted, and an upper zone wherein the light reject material is subjected to a washing action to separate the good fiber therefrom and to carry it through the screen cylinder to the accepts chamber.

Reject material which reaches this upper chamber is trapped against recirculating to the screening zone, and it is then carried further upwardly into an annular reject chamber in which it is retained while being concentrated by circulating about the inner wall of this chamber until the quantity of reject material in the chamber increases sufficiently to be carried out by way of a passage having its inner end at the radially inner portion of the reject chamber and leading to a reject outlet port in the outer wall of the reject chamber. Special provision is also made in accordance with the invention for supplying washing liquid to the washing zone of the screening chamber from above, as well as to the reject chamber, in order to promote separation of good fiber from reject material and to carry the separated fiber to perforations in the screen cylinder for passage thereto to the accepts chamber.

Special provision is made for dewatering the reject material discharged from the reject port to a condition in which it can be handled as a relatively dry mass while the liquid removed therefrom is handled separately. More specifically, a small screw press assembly is mounted directly on the reject port so that solid material flowing out through the reject port is trapped and then simultaneously compressed and dewatered to a relatively dry consistency in which it is discharged from the downstream end of the screw press assembly. The water removed therefrom by the screw press is then readily piped away to any other desired point in the system.

In summary, the screen of the invention offers special advantages for the treatment of tailings in that it accomplishes substantially complete separation of usable fiber from reject material, and especially also in that it delivers the reject material in such thoroughly dewatered form that it can be disposed of in any desired manner as an essentially dry mass. Further, by reason of its efficient and effective screening action, the screen of the invention can be equipped with a screening cylinder having screening perforations of such small size as to reject virtually all contaminant particles, even including those of specific gravities so close to those of wet paper fibers as to be incapable of separation therefrom by gravitational or centrifugal forces.

Other objects and advantages of the invention will be apparent from the following description, the accompanying drawings and the appended claims.

DESCRIPTION OF THE PREFERRED EMBODIMENTS

Figure 1:
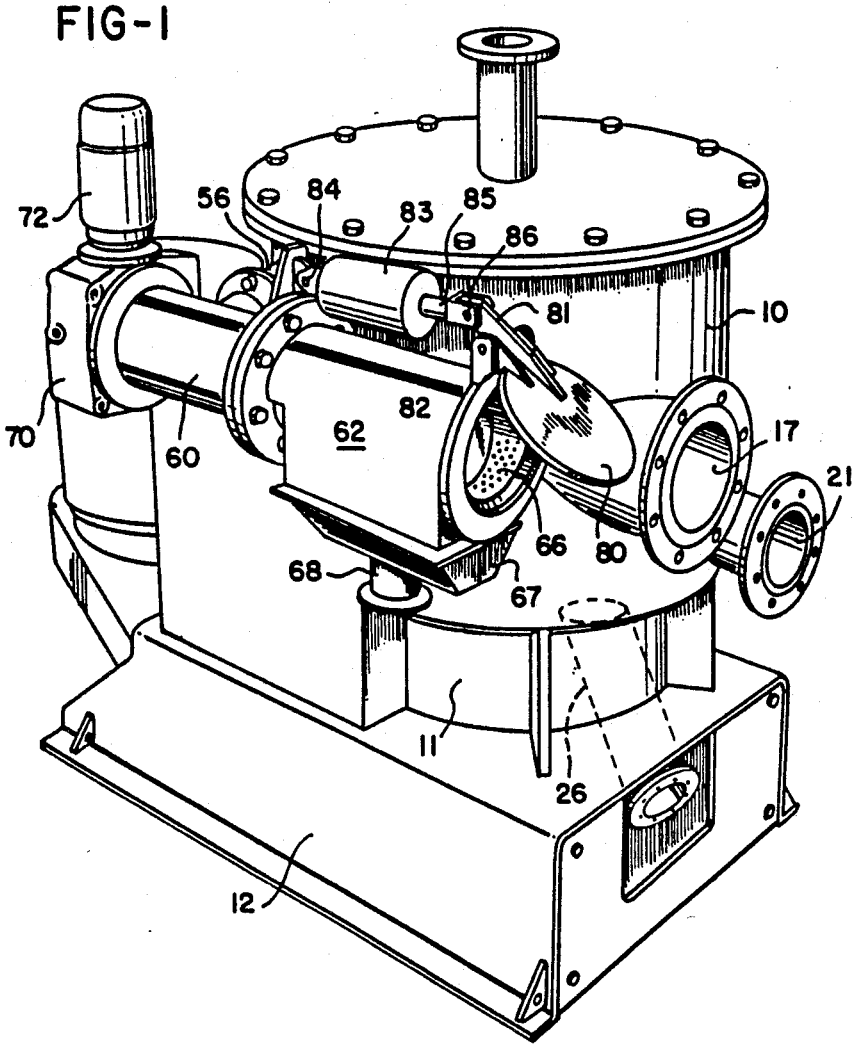
FIG. 1 is a perspective view illustrating the form of screening apparatus in accordance with the invention.

The screening apparatus shown in FIGS. 1–4 comprises a generally cylindrical vertical housing 10 mounted by a stand 11 on a base 12. A cylindrical perforate screen member 13 divides the central portion of the interior of the housing 10 into a screening chamber 15 and an annular accepts chamber 16 having an outlet port 17. The screening member 13 is provided with multiple perforations which may be of any conventional size, shape and spacing, a typical example being circular holes 0.062 inch in diameter and in such spacing as to provide an open area in the range of 10–15%. Alternatively, these perforations may comprise slots of the sizes and spacings disclosed in Seifert U.S. Pat. No. 3,842,302, and the screening member may also be of the type shown in Chupka-Seifert U.S. Pat. Nos. 4,155,841 or 4,383,918.

Below the screening member 13 is the inlet chamber 20, to which stock to be screened is supplied by way of a tangential inlet port 21. The screening member 13 is supported at its lower end by an annular flange 22 extending inwardly from the wall of housing 10 and cooperating therewith to define an annular space 25 which extends around the outside of the inlet chamber 20 and has an inner diameter equal to that of the lower end of screening member 13.

The tangential entry of the stock through the inlet port 21 creates centrifugal force effective to carry high specific gravity material, e.g. tramp metal, into this space 25 where it is retained by the flange 22 against entry to the screening chamber 15. A discharge port 26 from space 25 acts as a collection boot for trapping such reject material and may be provided with a suitable valve for periodic or intermittent dumping as disclosed in the Weber patent.

Within the screening chamber 15 is a rotor assembly indicated generally at 30 and including a hub 31 secured to the upper end of a drive shaft 32 supported by a suitably sealed bearing assembly 33 on a bracket 34 mounted within the stand 11. The rotor assembly is shown as comprising four vanes 35 mounted by arms 36 on the hub 31. Preferably, the rotor hub 31 is a cylindrical body of substantial diameter in order to reduce the radial dimension of the screening chamber 15 in accordance with principles of the invention as described hereinafter.

The rotor hub 31 is provided adjacent its upper end with a radially extending flat disk baffle 40 having a circular periphery, except where it is cut out to accommodate the vanes 35. The baffle 40 constitutes a partition separating the screening chamber 15 into a lower zone 41 and an upper zone 42, and the outer diameter of the baffle 40 is slightly smaller than the inner diameter of the screening member 13, e.g. one inch, to provide a correspondingly restricted annular passage 44 connecting these zones 41 and 42.

An additional baffle 45 of inverted frustoconical shape is also mounted as shown on the rotor hub 31 and secured to the underside of the baffle 40. This frustoconical baffle 44 further restricts the size of the lower screening chamber zone 41, and it also serves to direct the upward flow of stock from the inlet chamber 20 radially outward towards the annular passage 44, as further explained hereinafter.

The uppermost section of the housing 10 encloses a chamber 50 which corresponds to the reject chamber for low specific gravity materials in the screening apparatus of the Weber patent, but in accordance with the present invention, special features are incorporated in this chamber to minimize the possibility of recirculation of any stock from the upper end of the screening chamber to the lower end thereof. These provisions have the dual objective of reducing the possibility of inclusion of such reject materials in the accepted stock, and also of accumulating, and thus concentrating, such reject material in the upper part of the housing for ultimate discharge in substantially dewatered condition as described hereinafter.

An annular disk baffle 51 is positioned in the chamber 50 to overlie the screening chamber 15. The inner diameter of the baffle 51 is approximately equal to the inner diameter of the screening chamber 15, and a cylindrical baffle 52 depends from the inner periphery of the baffle 51 into the upper end of the screening chamber 15, and preferably into closely spaced relating with the partition baffle 40. The cylindrical baffle 52 thus forms an inner wall for the upper screening chamber zone 42, and it also cooperates with the horizontal baffle 51 to form a restricted annular chamber 55 for receiving stock which flows upwardly from the screening chamber carrying low specific gravity reject materials. An outlet port 56 for this stock leads tangentially from the chamber 55.

In operation, the stock to be screened is supplied to the inlet chamber 20 through inlet port 21 at sufficient velocity, e.g. 400–600 ft. min., to develop enough centrifugal force within the inlet chamber to cause any high specific gravity contaminant materials to travel directly to and around the peripheral wall of chamber 20. These heavy reject materials will accordingly be concentrated in the annular space 25 and delivered from there by centrifugal force into the reject port 26. None of this heavy reject material will therefore be able to reach the screening chamber 15 through the flow passage thereto defined by the inner periphery of the flange 22 which supports the lower end of the screening member 13.

The action of the rotor assembly 30 will have a number of effects on the solid material initially mixed with the feed stock. It will initially create additional centrifugal force causing the good fiber, which is slightly heavier than water, to travel to and through the screening member 13.

There will also be an initial tendency to cause rejects of specific gravities less than water to concentrate in the radially inner portion of the screening chamber. This tendency however, will be overcome by the outward funneling effect of the frustoconical baffle 45 in combination with the pressure behind the feed stock, which will tend to channel all of the stock in the screening chamber zone 41 radially outwardly and upwardly towards and through the annular passage 44 leading to the upper zone 42. Thus a major part of the good fiber in the entering flow will pass to the accepts chamber 16 before it reaches the passage 44, while the solid materials retained in the stock which flows through the passage 44 will consist primarily of low specific gravity reject materials.

As soon as this reject-carrying stock reaches the upper screening chamber zone 42, the low specific gravity materials therein will be free to move radially inwardly toward the cylindrical baffle 52, while whatever good fiber remains in zone 42, and which is of higher specific gravity than water, will tend to separate from the reject materials for passage through the upper part of screening member 13 into the accepts chamber 16. The upper portions of the rotor vanes will continue to exert a circulatory force in the zone 42, causing the low specific gravity materials therein to circulate around the cylindrical baffle 52 and up into the annular chamber 55. The liquid exiting from chamber 55 through the discharge port 56 will initially be relatively free of entrained particles. Very quickly, however, the concentration of light reject particles in the chamber 55 will increase to the point that some will be entrained in the existing stock in correspondingly increasing concentrations.

The effectiveness of this screening apparatus is further increased by supplying washing liquid to the reject chamber 55 in order to enhance the separation in that chamber of good fiber from reject particles. For this purpose, the upper chamber 50 is provided with a water inlet 57 in its top wall 58, and water is supplied through that inlet at sufficient pressure to cause it to enter the screening chamber zone 42 through the clearance between the lower end of the cylindrical baffle 52 and the rotor hub and partition baffle 40 thereon. This flow of washing liquid into the chamber 55 has the dual effect of preventing light reject particles from escaping into the chamber 50, and also of washing good fiber free from the light reject material in zone 42.

In summary, it will now be seen that while the construction of the invention provides a number of significant operating and functional advantages, the most important operational feature being that the light reject materials entrained in the feed flow of stock are forced very quickly to and through the annular passage 44 into the upper screening chamber zone 42. Further, the light reject materials which reach the zone 42 are prevented from recirculating within the housing 10 back to the lower end of the screening chamber 15 and its lower zone 41 and must therefore pass on into the reject chamber 55.

Thus light reject particles have effectively only one chance to be carried through the screening apertures in the member 13 into the accepts chamber, namely as they approach and pass through the annular passage 44. Once they are above the baffle partition 40, the centrifugal forces will work to keep these particles away from the screening member and cause them to be concentrated in the reject chamber 55 until they exit through the rejects port 56. Both the concentration of the reject particles and the separation therefrom of good fiber are also enhanced by the provision of the invention for adding wash water to the screening chamber zone 42.

Figure 3:
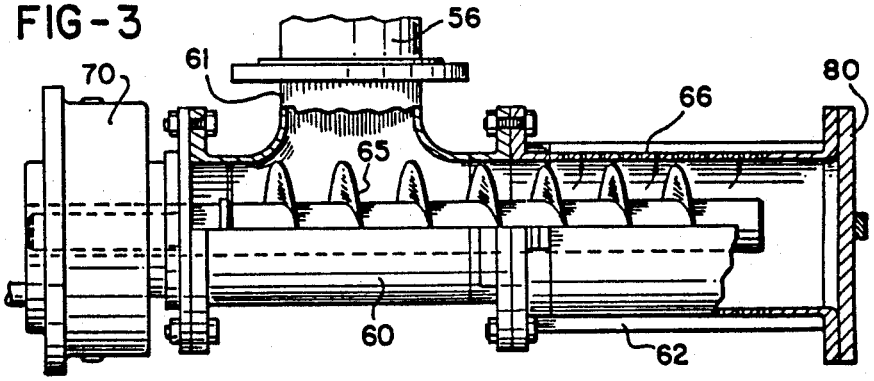
FIG. 3 is a section generally on the line 3—3 of FIG. 1.

Special provision is also made in accordance with the invention for dewatering the concentrated low specific gravity reject material before it is discharged from the screen apparatus. Referring specifically to FIGS. 1 and 3, a T-fitting 60 has its central port 61 directly mounted on the reject discharge port 56, and a casing 62 is mounted on one of the other two ports of this fitting. Mounted within the combined fitting 60 and casing 62 is a screw press comprising a compaction screw 65 extending through the major part of the fitting 60 and also in the casing 62, and a perforated cylinder 66 mounted within the casing 62. There is sufficient annular space between the parts 62 and 66 to receive liquid which is extruded through the perforations in the part 66, and which collects in a trough 67 forming the bottom of casing 62 and having an outlet port 68.

The end of the screw 65 away from the screen member 66 is mounted in a gear transmission 70 secured to the other port of fitting 61 and provided with a drive motor 72. Thus solid materials reaching the fitting 60 from the reject discharge port 56 are compressed by screw 65 in the perforated cylinder 66, and the liquid extruded therefrom flows into the trough 67 to an outlet port 68. From this pipe, the liquid is recirculated by suitable piping, not shown, to any other desired point in the system.

The compacted reject material collects at the outer end of the casing 62, which is normally closed by a cover plate 80 that includes a supporting arm 81 having a pivotal mounting 82 on the casing 62 about which cover plate 80 can swing into and out of closing relation with the open end of casing 62. The cover plate 80 is normally biased to closed position by means such as a fluid pressure cylinder 83 having its closed end pivotally mounted at 84 on the other end of the casing 62 and having its piston 85 pivotally connected at 86 to the cover plate arm 81.

In operation, the cylinder 83 is supplied with operating fluid at a predetermined pressure in the direction to hold the cover plate 80 closed, and thereby to maintain the interior of the housing 10 under pressure. Then as the solid material accumulates between the inner surface of cover plate 80 and the screw 65, it will overcome this pressure, force the cover plate open, and discharge as relatively dry compacted solid material into a suitable receptacle, not shown. The degree of dryness can readily be controlled by regulation of the operating pressure in cylinder 83, in that extrusion of the reject material can occur only after it has been dewatered to a sufficiently compacted consistency to form a plug which forces cover plate 80 open against that pressure while maintaining the pressurized conditions inside housing 10.

Figure 2:
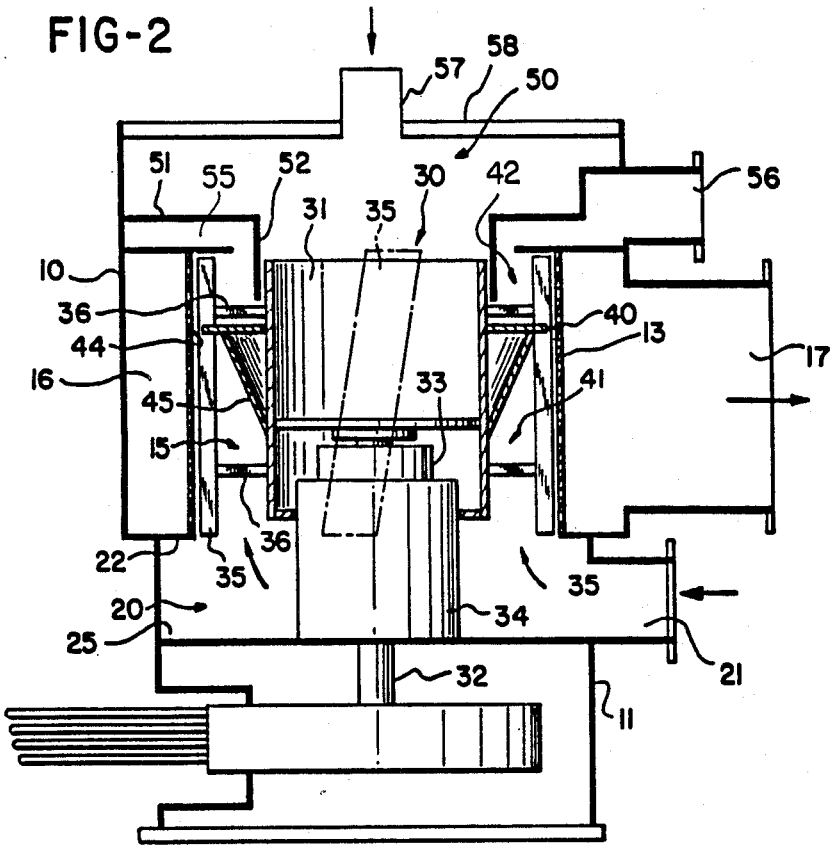
FIG. 2 is a somewhat diagrammatic view, generally in vertical section, showing the operation and internal construction of the screening apparatus of FIG. 1.

In the form of the invention shown in FIGS. 4 and 5, the parts corresponding to those already described in connection with FIGS. 1–3 are similarly numbered 110, 111 and so forth. As in FIGS. 1–3, a cylindrical perforate screen member 113 divides the central portion of the interior of the housing 110 into a screening chamber 115 and an annular accepts chamber 116 having an outlet port 117. The stock enters the lower end of the screening chamber 115 from an inlet chamber 120 wherein high specific gravity reject material is trapped for separate removal as previously described.

The rotor assembly 130 includes a hub 131 secured on the upper end of the drive shaft 132. This rotor assembly is shown as incorporating two oppositely disposed vanes 135 which are mounted on the hub 131 by arms 136 extending from the lower portion of the hub, and by the flat disk baffle 140, which has the same function as the baffle 40 in separating the screening chamber into a lower zone 141 and an upper zone 142 connected by an annular passage 144 The inverted frustoconical baffle 145 functions in the same manner as described for baffle 45, and it also serves as a brace for the flat disk baffle 140. Both of baffles 140 and 145 are shown as provided with a plurality of evenly distributed holes 146 and 147 which contribute to the washing operation of this screen as described hereinafter.

Figure 4:
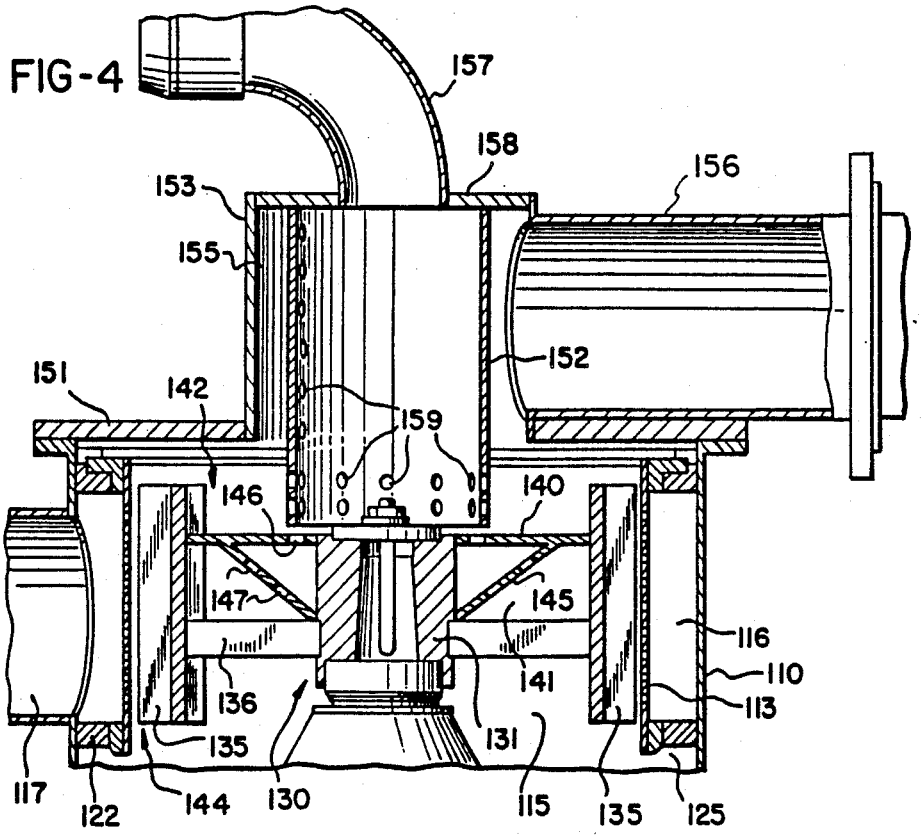
FIG. 4 is a fragmentary section similar to FIG. 2 and showing a modified form of screening apparatus in accordance with the invention.
Figure 5:
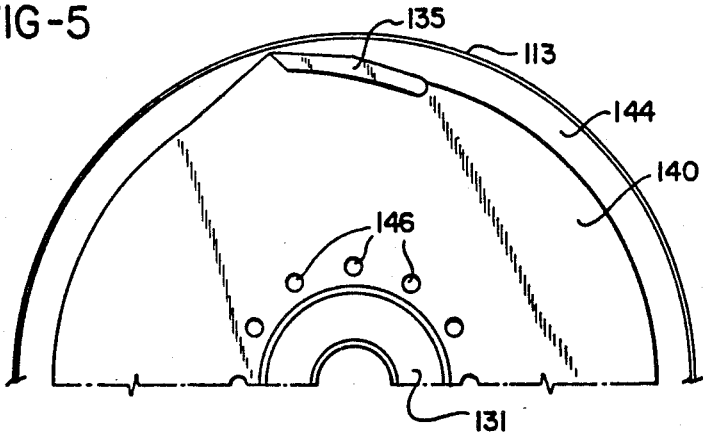
FIG. 5 is a fragmentary section on the line 5—5 of FIG. 4.

In the screen of FIGS. 4 and 5, the annular top plate 151 corresponds to the annular baffle 51 in FIG. 2 and supports a cylindrical casing 153 which cooperates with a cylindrical baffle 152 to define an annular reject chamber 155 The outlet port 156 from chamber 155 is shown as leading radially from the casing 153 but could of course be located to extend tangentially therefrom if desired.

At its upper end, the interior of the cylindrical baffle 152 is connected with a supply pipe 157 for washing water which extends upwardly from the top cover 158 for casing 153. The cylindrical baffle 152 extends at its lower end into relatively closely spaced relation with the upper surface of disk baffle 140 to provide a cylindrical slot therebetween through which washing liquid can flow into the upper zone 142 of the screening chamber.

In addition, the cylindrical baffle 152 is provided with multiple discharge holes 159 for washing liquid which are spaced around its periphery in that portion of the baffle below the level of the cover plate 151. Above that level, however, there are similar holes 159 only in the portion of the wall of cylindrical baffle 152 facing away from the reject outlet 156, and there are no such holes through which washing liquid can be discharged directly toward the reject outlet port 156.

The operation of this form of screen is essentially the same as already described in connection with FIGS. 1–3, except for the enhanced washing effect, not only on the stock in the upper zone 142, but also in the lower zone 141 by reason of the series of holes 146 and 147 through wash liquid from the interior of the cylindrical baffle 152 can pass directly into the lower zone 141 of the screening chamber. Thus the radially outward flow of washing liquid through the holes 147 in the frustoconical baffle 145 will promote separation of good fiber from reject material in the lower screening chamber zone 142, while also adding a flow component to the suspension in that zone which will accelerate the movement of lower specific gravity materials to and through the passage 144 to the upper zone 141.

In that upper zone, and also in the reject collecting chamber 155, there will be enhanced washing action by the washing liquid discharged through the holes 159, which will act both on the stock which has already reached the reject chamber 155, and especially on the stock in the zone 142. Also, the centrifugal forces developed by the rotor will affect materials suspended in the liquid while they are in the chamber 155, so that they will be caused to circulate around and close to the cylindrical baffle 152 and thereby be concentrated in the radially inner portion of the chamber 155 adjacent the baffle 152. With the outlet from this chamber provided by a pipe 156 which, as shown, has its inlet end relatively close to the cylindrical baffle 152, the outward flow of liquid through pipe 156 will entrain the lightweight solid materials as they move toward the central axis of the apparatus and thereby remove them from the chamber 155.

It is important to recognize that the screening, washing and collection of reject material carried out in the screen of the invention is not limited to the separation of good fiber from lower specific gravity materials. Quite to the contrary, a common constituent in the tailings from the primary screening station of a waste paper system has been found to comprise small bits of wet strength paper which are of essentially the same specific gravity as good paper fibers. Such reject pieces which are too large for passage through the perforations in the screening cylinder 113 are caused to travel upwardly within the screening chamber, and after they are rejected by the perforations in the screen member 113, the upward pressure flow will ultimately carry them into the reject chamber 155 from which they reach the outlet pipe 156.

It is to be understood that for optimum operating results, the screen shown in FIGS. 4 and 5 will also be provided with a dewatering screw press as described in connection with FIGS. 1 and 3 and as indicated fragmentarily at 160 in FIG. 4.

Figure 6:
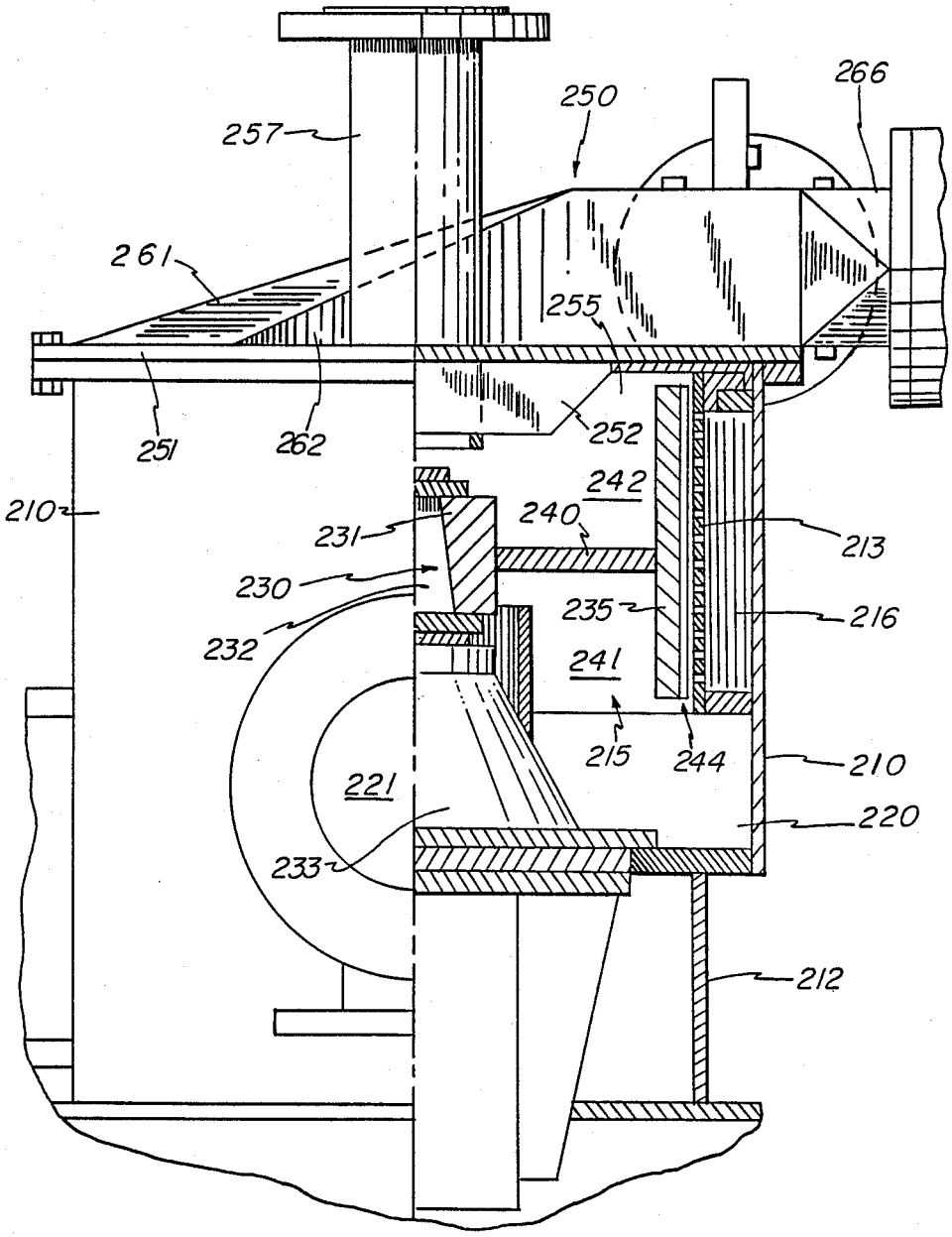
FIG. 6 is a sectional view on the line 6—6 of FIG. 7 showing a further modified form of screening apparatus in accordance with the invention.
Figures 7, 8:
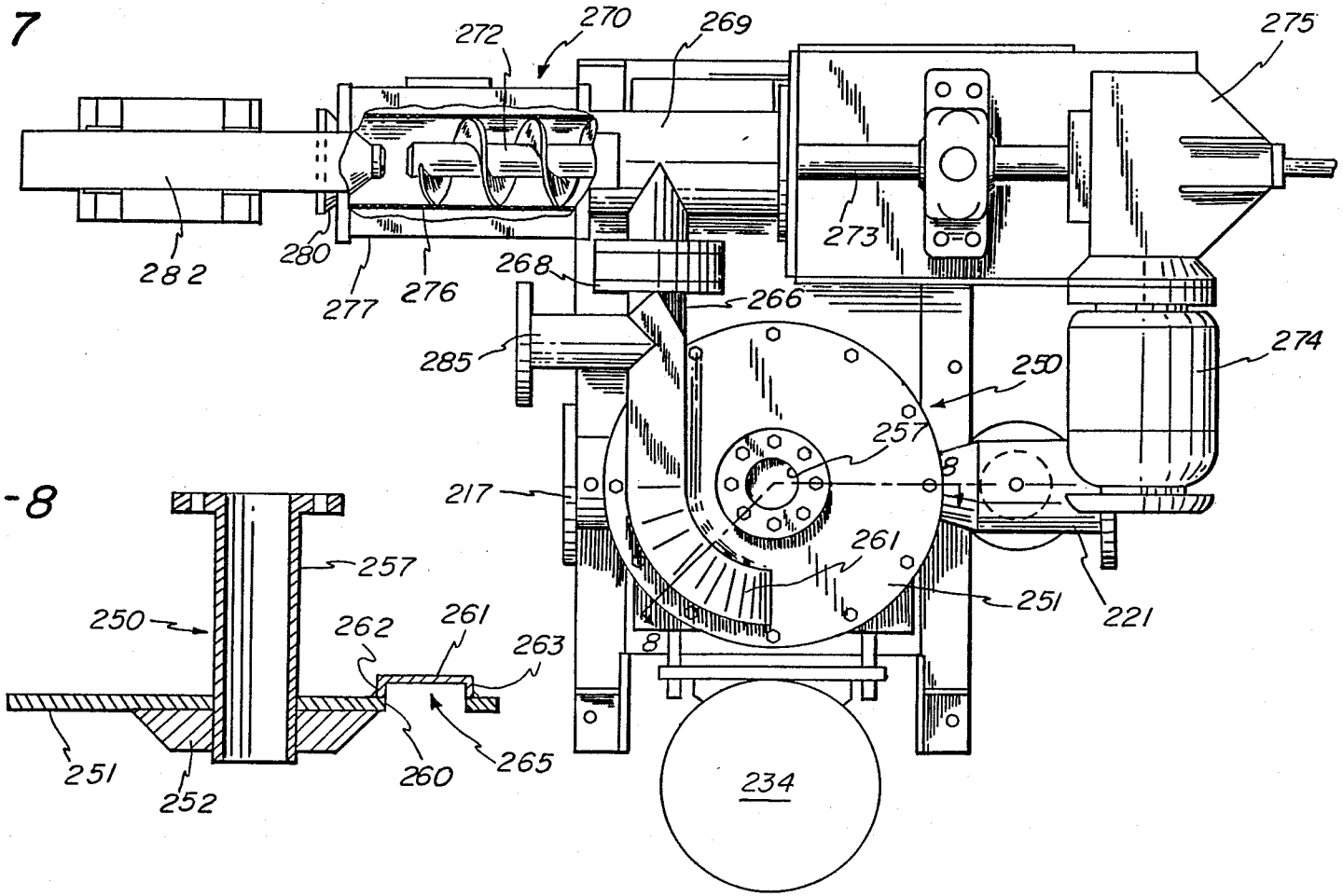
FIG. 7 is a plan view of the screening apparatus shown in FIG. 6.
FIG. 8 is a fragmentary section taken on the line 8—8 of FIG. 7.

In the form of the invention shown in FIGS. 6–8, the generally cylindrical vertical housing 210 is mounted on a base 212, and a cylindrical perforate screen member 213 divides the central portion of the interior of the housing 210 into a screening chamber 215 and an annular accepts chamber 216 having an outlet port 217. The stock enters the lower end of the screen chamber 215 from an inlet chamber 220 and inlet port 221.

The rotor assembly 230 is shown as of essentially the construction disclosed in Chupka et al U.S. Pat. No. 4,663,030, issued May 5, 1987 to the assignee of the present application. It includes a hub 231 secured on the upper end of the drive shaft 232 which is in turn supported by bearings in the bearing housing 233 and drive by motor 234. Two or four oppositely disposed vanes 235 are mounted on the hub 231 by a flat disk 240, which is secured to hub 231 and also has the same function as the baffle 40 in separating the screening chamber into a lower zone 241 and an upper zone 242 connected by the annular passage 244 between the rotor assembly and the screening cylinder 213. The disk baffle 240 may be provided with holes therethrough for additional communication between the zones 241 and 242.

The screening apparatus of FIGS. 6–8 includes a cover assembly 250 of which the main structural member is a circular plate 251 secured on the top of the housing 210. A frustoconical element 252 which may be hollow or solid as shown, is welded or otherwise secured to the underside of the plate 251 and depends therefrom into the zone 242 to form a baffle which also defines the radially inner wall of the reject chamber 255. The cover assembly 250 also includes a pipe 257 which extends concentrically through the plate 251 and baffle element 252 into the zone 242 to supply washing liquid thereto.

The outlet passage from the reject chamber 255 includes an arcuate opening 260 cut through the plate 251 and extending for 90° around the upper periphery of the baffle element 252, namely from the 6 o'clock position to the 9 o'clock position as viewed in FIG. 7. This opening is provided with an upwardly sloping and curved wall comprising a top 261 and inner and outer sides 262 and 263 which combine with the top plate 251 at the 9 o'clock position as viewed in FIG. 8 to define an outlet passage 265 of rectangular cross-section which becomes square at its outermost end.

A short pipe 266 is configured with a square end for welded attachment to the square ends of the walls of the passage 265, and its other end is cylindrical and includes a mounting flange 268 by which it is connected to the T-fitting portion 269 of a dewatering press assembly 270 of essentially the same characteristics already described in connection with FIGS. 1 and 3. More specifically, the compaction screw 272 is on the forward end of a shaft 273 driven by a motor 274 through a transmission 275. The screw 272 is surrounded by a perforated cylinder 276, and the liquid extruded therethrough falls to an outlet (not shown) from the bottom of the housing 277.

The reject material dewatered in cylinder 276 is discharged from the end of housing 277 by forcing back a conical closure plug 280 which is pressed against the discharge opening from housing 277 by an air cylinder 282 to maintain the pressurized conditions in housing 210. There is also an outlet pipe 285 from the side of the pipe 266 which is normally closed but can be used as an option to provide for direct discharge of the concentrated suspension of light reject materials from the reject outlet passage 265 without further dewatering if desired.

The operation of the screening apparatus shown in FIGS. 6–8 is essentially the same as already described in connection with FIGS. 1–6. In particular, the vortex action created by the rotor 230 will cause the relatively light reject material to migrate toward the rotor axis and thus to collect adjacent the radially inner wall of the reject chamber 255 provided by the member 252. Since this inner wall is frusto-conical, the low specific gravity of the accumulating reject material will cause it to rise, guided by the surface of element 252, into and through the reject outlet 260 in the cover plate 251 and into the reject outlet passage 265. Since the entire interior of the housing 210 is under pressure, this reject material will be entrained in the flow to and through the outlet pipe 266 and thence to the dewatering press assembly 270 where it will be separated into relatively dry and compressed solid material and liquid.

While the forms of apparatus herein described constitute preferred embodiments of this invention, it is to be understood that the invention is not limited to these precise forms of apparatus, and that change may be made therein without departing from the scope of the invention which is defined in the appended claims.

What is claimed is:

1. Apparatus for screening paper fiber stock, such particularly as tailings from a primary screen, containing good fibers mixed with reject materials of lower specific gravity than the good fibers, comprising:

(a) a housing including a generally cylindrical vertical side wall and a top wall, (b) means defining an inlet chamber in the lower end of said housing and including a stock inlet port to said inlet chamber, (c) screening means including a cylindrical perforate screening member supported in an intermediate portion of said housing above said inlet chamber and separating said portion into a screening chamber and an annular accepts chamber on the inner and outer sides of said screening member respectively, (d) means defining an outlet port from said accepts chamber, (e) means in said housing defining an annular reject chamber above and in direct communication with said screening chamber for receiving therefrom stock containing said lower specific gravity materials, (f) means forming a radially inner wall in said rejecting chamber which is of circular section and substantially smaller radius than said screening member, (g) rotor means in said screening chamber mounted for rotation on the vertical axis of said screening member and including a hub and vanes mounted in radially inwardly spaced relation with said screening members and outwardly spaced relating with said hub to provide an annular space between said hub and said vanes, (h) means for driving said rotor to cause said vanes to effect circulatory movement of the stock in said screening and reject chambers while subjecting said stock to centrifugal force to effect concentration of said lower specific gravity materials in said annular space adjacent and around said hub and around said inner wall in said reject chamber while causing said good fibers to travel outwardly to said screening member, and (i) means defining a reject outlet passage leading to the outside of said housing from a portion of said reject chamber adjacent said inner wall thereof for removing said concentrated lower specific gravity materials from said housing.

2. Screening apparatus as defined in claim 1 wherein said reject outlet passage comprises an opening in said housing top wall overlying a portion of said reject chamber whereby said concentrated reject materials flow directly upwardly into said reject outlet passage.

3. Screening apparatus as defined in claim 1 wherein said reject outlet passage comprises an arcuate opening in said housing top wall concentric with said rotor means and having an inner radius substantially equal to the outer radius of said inner wall whereby said concentrated reject materials flow directly upwardly into said reject outlet passage.

4. Screening apparatus as defined in claim 2 wherein said inner wall of said reject chamber is of inverted frustoconical shape to guide said concentrated reject materials upwardly and radially outwardly to said reject outlet opening.

5. Screening apparatus as defined in claim 1 further comprising means connected to said reject outlet passage for dewatering said concentrated reject materials and removing said dewatered materials from the outlet end of said passage while maintaining a sufficient volume of said materials in said passage to prevent loss of pressure therethrough from the interior of said housing.

6. Screening apparatus as defined in claim 5 wherein said dewatering means comprises:

(a) a tubular casing connected with said outlet passage to receive said concentrated reject material therefrom, (b) screw press means within said casing for compressing solid materials received from said outlet passage and separately discharging the resulting compressed solid materials and the liquid by which the same were carried into said casing, and (c) closure means for said casing biased to closed position and yieldable to open position in response to movement of said compressed solid materials thereagainst by said screw press means.

7. Screening apparatus as defined in claim 5 wherein said dewatering means comprises:

(a) a T-fitting having its center port connected with said reject outlet passage, (b) a casing mounted on one of the other ports of said fitting, (c) a perforate cylindrical screen member mounted within said casing, (d) a feed screw positioned in said screen member, (e) means including a shaft extending through the third port of said fitting for driving said feed screw to compress solid materials received from said outlet port in said screen member and thereby to dewater said compressed materials by forcing the liquid therefrom through said screen member perforations, (f) means forming separate discharge ports for liquid and solid materials from said casing; and (g) a closure for said solid materials port biased to closed position and yieldable to open position in response to movement of said compressed materials thereagainst by said feed screw.

* * * * *